United States Patent [19]

Thomasson

[11] Patent Number: 4,890,398

[45] Date of Patent: Jan. 2, 1990

[54] SHOE SOLE

[76] Inventor: Robert Thomasson, 20200 87th Ave. South, Kent, Wash. 98032

[21] Appl. No.: 267,174

[22] Filed: Nov. 4, 1988

Related U.S. Application Data

[63] Continuation-in-part of Ser. No. 124,024, Nov. 23, 1987, abandoned.

[51] Int. Cl.[4] ..... A43B 5/00

[52] U.S. Cl. ..... 36/114; 36/25 R; 36/59 C; D2/320

[58] Field of Search ..... 36/25 R, 28, 31, 59 C, 36/71, 114, 115; D2/309, 310, 312, 320, 321

[56] References Cited

U.S. PATENT DOCUMENTS

| | | | |
|---|---|---|---|
| D. 72,474 | 4/1927 | Calvin | D2/321 |
| D. 80,001 | 11/1929 | Wydom | D2/321 |
| D. 213,417 | 3/1969 | Dittmar, Jr. | D2/320 |
| D. 254,579 | 4/1980 | Cassels | D2/321 |
| D. 275,146 | 8/1984 | Kilgore | D2/320 |
| D. 287,784 | 1/1987 | Tong et al. | D2/320 |
| 4,134,220 | 1/1979 | Dassler | 36/114 |
| 4,358,902 | 11/1982 | Cole | 36/28 |
| 4,550,510 | 11/1985 | Stubblefield | 36/32 |
| 4,676,011 | 6/1987 | O'Rourke | 36/114 |

FOREIGN PATENT DOCUMENTS

| | | | |
|---|---|---|---|
| 2458576 | 6/1976 | Fed. Rep. of Germany . | |
| 2457652 | 12/1980 | France . | |
| 508720 | 1/1955 | Italy | 36/25 R |
| 120865 | 2/1948 | Sweden | 36/25 R |
| 132750 | 9/1919 | United Kingdom . | |
| 190677 | 12/1922 | United Kingdom | 36/59 C |

*Primary Examiner*—Werner H. Schroeder
*Assistant Examiner*—Diana L. Biefeld
*Attorney, Agent, or Firm*—Delbert J. Barnard

[57] ABSTRACT

A primary pivot pad (28) is positioned on the sole (12) of a shoe (10) below the ball region of the user's foot. A secondary pivot pad (30) is positioned on the sole (12) forwardly of the primary pivot pad (28). A second secondary pivot pad (20, 20') is positioned on the sole (12) both rearwardly and laterally inwardly from the primary pivot pad (28). The secondary pivot pad (20) may be positioned primarily rearwardly and somewhat laterally (FIG. 2) or may be positioned primarily laterally and only slightly rearwardly (FIG. 13). Each pivot pad presents a downwardly directed pivot surface having a pivot center. The primary pivot pad (28) extends into each secondary pivot pad (20, 20', 30) and truncates each secondary pivot pad (20, 20', 30).

12 Claims, 4 Drawing Sheets

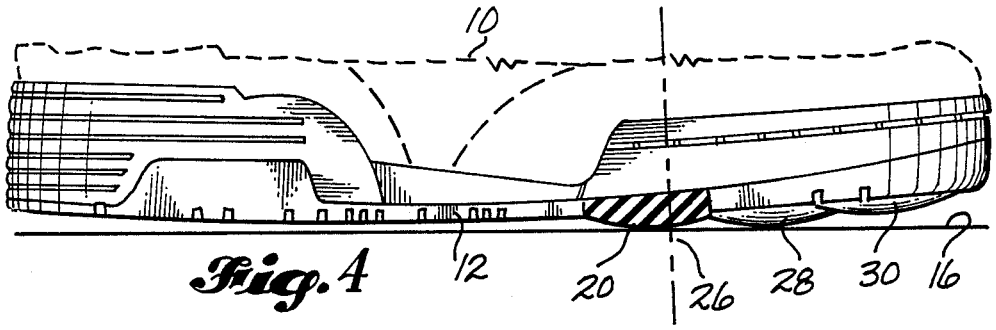
Fig. 4
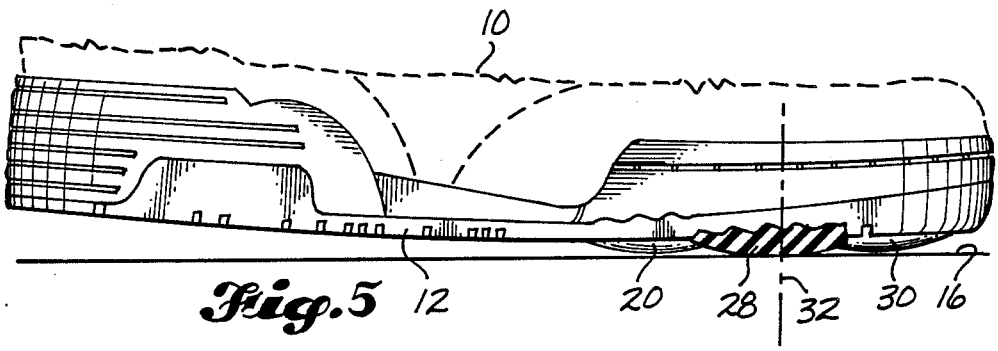
Fig. 5
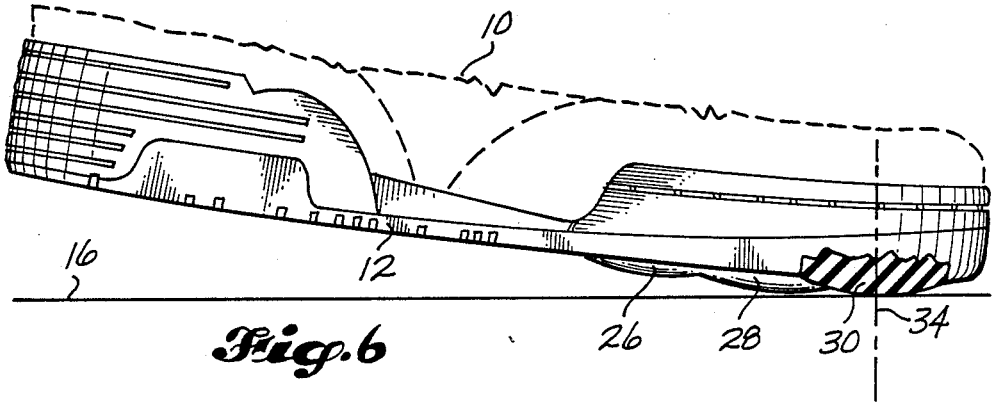
Fig. 6
Fig. 7
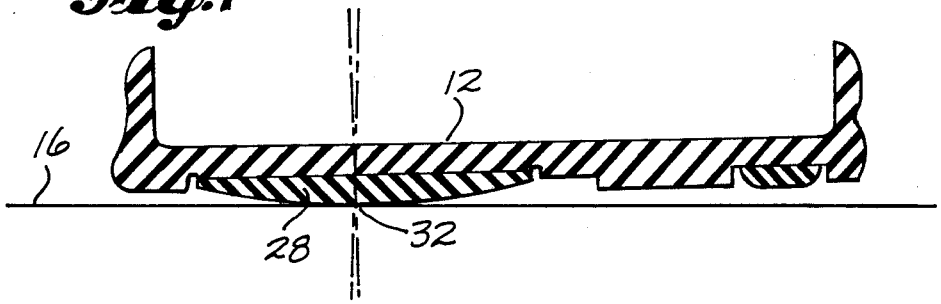

SHOE SOLE

RELATED APPLICATION

This application is a continuation-in-part of my copending application Ser. No. 07/124,024, filed Nov. 23, 1987, now abandoned and entitled Basketball Shoe Sole.

DESCRIPTION

TECHNICAL FIELD

The present invention relates to athletic shoes More particularly, it relates to a shoe bottom construction which allows the wearer to easily pivot on the shoe when his weight is on the ball region of his foot and also when his weight is on at least one other region of his foot offset from the ball region.

BACKGROUND ART

Some sports require the participants to pivot in position on one foot. Basketball is an example of a sport in which during the play of the game the players frequently pivot on a planted foot while stepping with the other foot either forwardly or rearwardly It is known to construct an athletic shoe which includes a pivot pad on the bottom of a shoe below the ball region of the user's foot, to facilitate pivotal movement while the user's weight is being applied to the shoe through the ball region of his foot An example of a shoe constructed in this manner is disclosed by German Patent Publication No. 2,458,576, published June 16, 1976.

It is also known to provide an athletic shoe with circular cleats for facilitating pivotal movement while the user's weight is applied to his shoe through the ball region of his foot Examples of a shoe of this type which are present in the patent literature are shown by U.S. Pat. No. 4,550,510, granted Nov. 5, 1985, to Jerry D. Stubblefield; by U.S. Pat. No. Des. 287,784, granted Jan. 20, 1987 to James K. Tong and Bruce MacGregor; by U.S. Pat. No. Des. 375,146, granted Aug. 21, 1984, to Bruce J Kilgore; and by French Pat. No. 2,457,652, granted Dec. 26, 1980.

A principal object of the present invention is to provide an athletic shoe having a nested plurality of pivot pads on the bottom of the shoe positioned for facilitating pivotal movement on the foot while the user's weight is applied to his shoe at locations other than the ball region of his foot, in addition to when the weight is applied to the shoe at the ball region of the foot.

DISCLOSURE OF THE INVENTION

A shoe constructed according to the present invention is basically characterized by a sole having a floor contacting bottom. The sole includes a primary pivot pad that is substantially circular in plan form. This primary pivot pad is located on the sole bottom generally below the ball region of the user's foot It presents a downwardly directed convex pivot surface having a pivot center. At least one secondary pivot pad is provided on the sole bottom adjacent the primary pivot pad. The primary pivot pad extends laterally into and truncates the secondary pivot pad. The secondary pivot pad has a concave side boundary adjacent the primary pivot pad. Otherwise, the secondary pivot pad has a substantially circular plan form. The secondary pivot pad presents a downwardly directed convex pivot surface having a pivot center.

In preferred form, the shoe has a primary pivot pad and two secondary pivot pads. One secondary pivot pad is positioned forwardly on the sole from the primary pivot pad. The second secondary pivot pad may be positioned either rearwardly and somewhat laterally of the primary pivot pad or may be positioned predominantly laterally and only somewhat rearwardly of the primary pivot pad. The former shoe construction is intended for use by a person who tends to shift his or her weight forwardly and rearwardly on the pivot foot. The latter construction is intended for a person who tends to shift his or her weight laterally on the pivot foot.

In preferred form, the sole bottom is formed to include parallel transverse slots on side regions of the shoe, for the purpose of rendering the bottom more flexible to facilitate bending of the sole in a direction perpendicular to the slots.

Other features, objects and advantages of the invention are hereinafter set forth, or will be apparent from, the detailed description of the illustrated embodiment

BRIEF DESCRIPTION OF THE DRAWING

Like reference numerals are used to designate like parts throughout the several views of the drawing, and:

FIG. 4 is a view like FIG. 1, but with the upper portion of the shoe omitted, such view showing the heel raised off of the support surface into a position wherein the user's weight is on the rear pivot pad;

FIG. 5 is a view like FIG. 4, but showing the heel raised an additional amount into a position placing the user's weight on the primary pivot pad;

FIG. 6 is a view like FIGS. 4 and 5 but with the heel raised an additional amount into a position placing the user's weight on the forward pivot pad;

FIG. 7 is an enlarged scale sectional view taken substantially along line 7—7 of FIG. 2, showing the shoe tipped laterally inwardly somewhat from its static position;

BEST MODE FOR CARRYING OUT THE INVENTION

Figure 1:
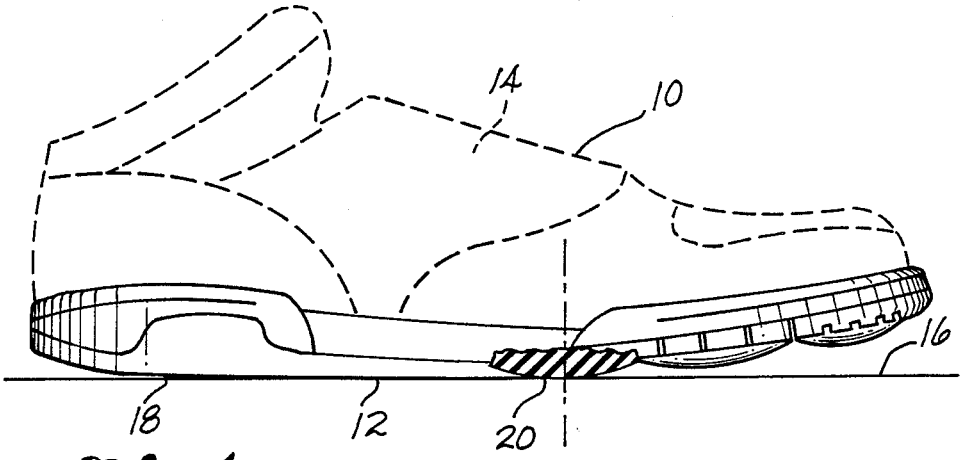
FIG. 1 is a side elevational view of an athletic shoe embodying the present invention, looking toward the inside of the shoe, with the upper portion of the shoe shown in phantom line, such view showing the static position of the shoe on a support surface and including a fragmentary sectional showing at a forward location of contact of the shoe bottom with the support surface.

Referring to FIG. 1, shoe 10 comprises a sole 12 and an upper 14 A left shoe 10 is illustrated. The right shoe is identical but adapted for the right foot and for that reason is not illustrated. The sole 12 is the only part of the shoe 10 that is involved in the invention and so it is the only part of the shoe that has been illustrated in any detail. Also, for the most part, the invention involves the region of the shoe that is forwardly of the arch region and for that reason the details of the arch region and the heel region have been omitted from FIG. 2.

Figure 2:
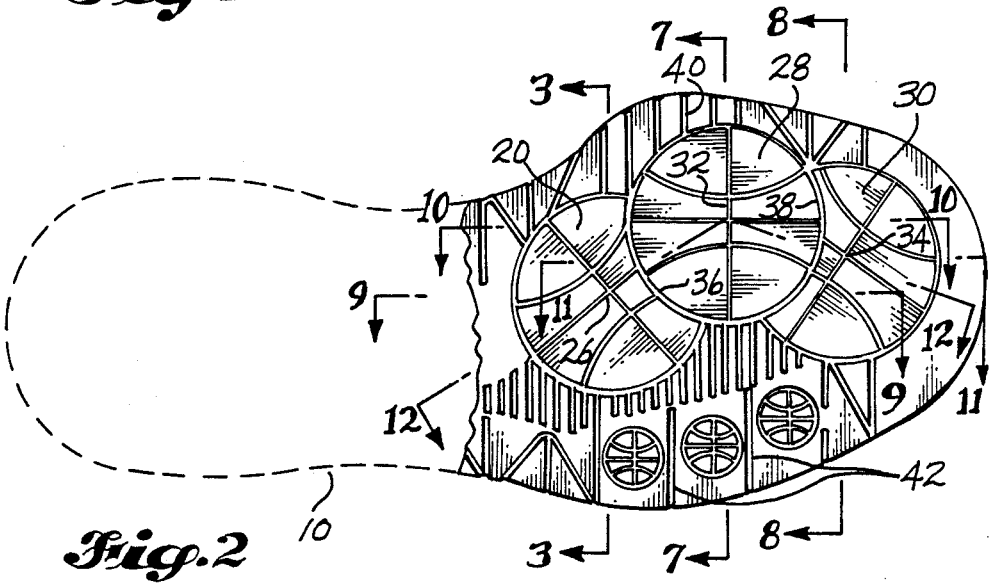
FIG. 2 is a bottom plan view of the sole of the shoe shown by FIG. 1, with the rear portion of the shoe shown in phantom line.
Figure 3:
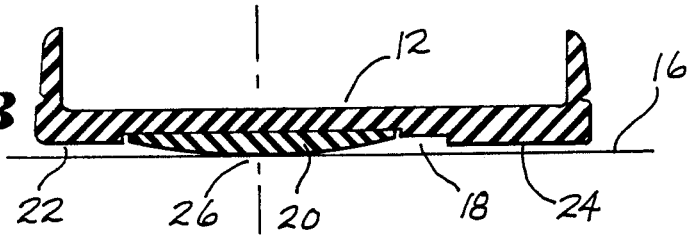
FIG. 3 is a cross sectional view taken substantially along line 3—3 of FIG. 2, with the shoe in a static condition.
Figure 8:
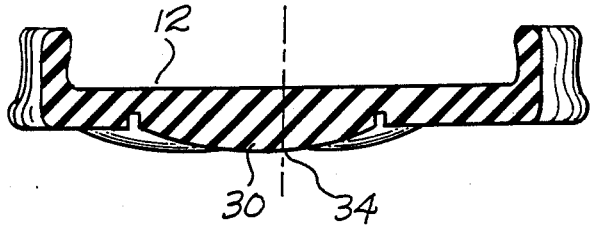
FIG. 8 is a sectional view taken substantially along line 8—8 of FIG. 2.
Figure 9:
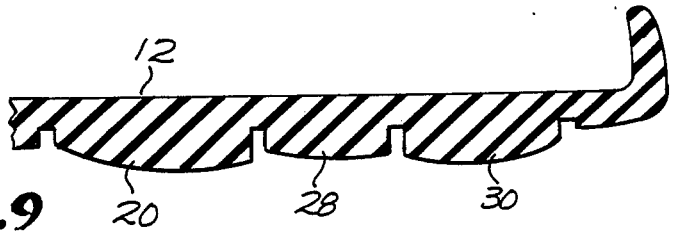
FIG. 9 is a fragmentary longitudinal sectional view taken substantially along line 9—9 of FIG. 2.
Figure 10:
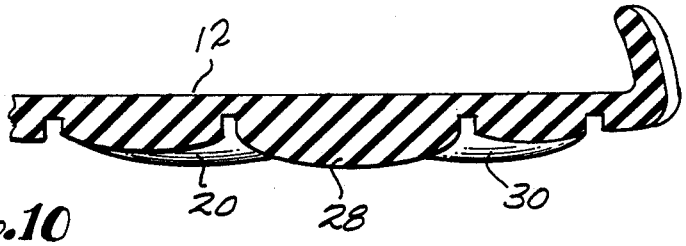
FIG. 10 is a fragmentary longitudinal sectional view taken substantially along line 10—10 of FIG. 2.

The static condition of the shoe 10 is shown by FIGS. 1 and 3. The expression "static condition" is used herein to mean the position taken by a shoe 10 when it is set down on a support surface 16. When the shoe 10 is in its static condition it is supported at its rear by contact between the heel portion 18 and the support surface 16. Forward contact is made between a pivot pad 20 and the support surface 16. As shown by FIG. 3, the bottom surface regions 22, 24 on the sole 12, on opposite sides of the pivot pad 20, are elevated above the support surface 16 when the shoe 10 is in a static condition The pivot pad 20 presents a downwardly directed convex surface. The center 26 of this surface is herein referred to as the pivot center. As shown by FIG. 1, when the shoe 10 is in a static condition the sole region forwardly of the pivot pad 20 is elevated above the support surface 16. Pivot pad 20 is positioned longitudinally of the shoe between the arch and ball regions of the user's foot. Referring to FIG. 2, a second pivot pad 28 is positioned forwardly of pivot pad 20. A third pivot pad 30 is positioned forwardly of pivot pad 28. As shown by FIG. 7, pivot pad 28 presents a downwardly convex surface and includes a pivot center 32. As shown by FIG. 8, pivot pad 30 presents a downwardly convex surface and it includes a pivot center 34.

In preferred form, the pivot pad 28 is a primary pivot pad. It is positioned generally below the ball region of the user's foot. Pivot pad 20 is substantially circular in plan form and on a typical shoe is in the order of about one and three quarters inches in diameter but this dimension may vary.

Pivot pads 20, 30 are herein termed secondary pivot pads. As shown by FIG. 2, primary pivot pad 28 extends laterally into and truncates both of the secondary pivot pads 20, 30. Pivot pad 20 has a concave side boundary 36 adjacent pivot pad 28. Pivot pad 30 has a similar concave boundary 38 adjacent pivot pad 28. Pivot pads 20, 30 are otherwise substantially circular in plan form By way of typical and therefore nonlimitive example, the convex surface of each pivot pad 20, 28, 30 may have a radius of curvature of about two and three fourths inches. However, it is not necessary that the convex surface be a true spherical surface. It may be slightly elliptical Pivot pad 28 has a cross sectional configuration of the type shown by FIG. 7 at every radial section taken through it for a full three hundred and sixty degrees about the pivot center 32. The same is true with respect to pivot pads 20, 30 except in the truncated regions. If the convex surface curvature of the pivot pads 20, 30 were to be continued through the truncated regions to a projected circular outer edge, the pivot pads 20, 30 would be identical to pivot pad 28. Preferably a groove is provided at the periphery of each pivot pad 20, 28, 30.

Figure 11:
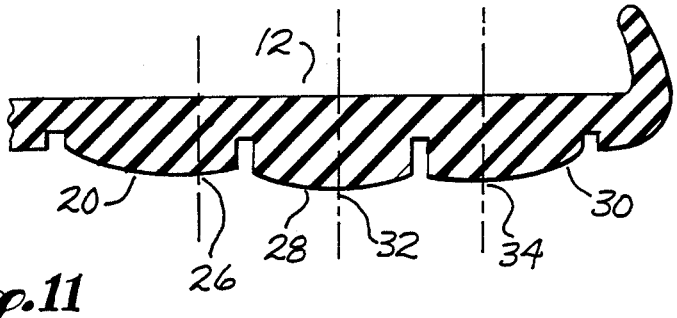
FIG. 11 is a fragmentary longitudinal sectional view taken substantially along line 11—11 of FIG. 2.
Figure 12:
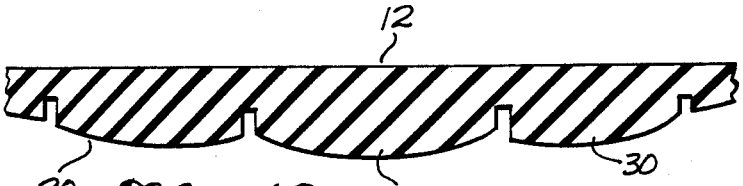
FIG. 12 is a fragmentary bent sectional view taken substantially along line 12—12 of FIG. 2.

As best shown by FIG. 11, the crown of pivot pad 28 is at the pivot center 32, and projects lower on the sole 28 than do the crowns of the pivot pads 20, 30. The crowns of pivot pads 20, 30 are also located at the pivot centers of these pads. The pivot center 32 of pivot pad 28 is the geometric center of the pivot pad 28. The pivot centers 26 o pivot pad 20 and 34 of pivot pad 30 are at the geometrical centers of circles which include the circular edges of these pads 20, 30.

Figure 13:
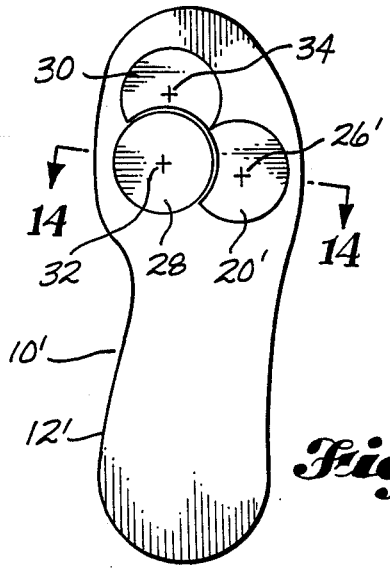
FIG. 13 is a bottom plan view of a second embodiment of the shoe, showing a modified pattern of the pivot pads.
Figure 14:
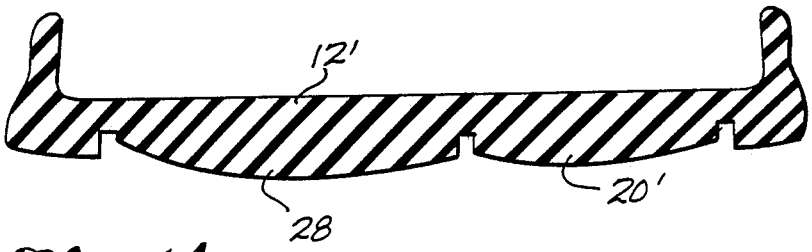
FIG. 14 is an enlarged scale sectional view taken substantially along line 14—14 of FIG. 13.

In the shoe shown by FIGS. 1–12 the forward pivot pad 30 is offset laterally in position towards the center of the shoe 10 from the position of pivot pad 20. Pivot pad 20 is offset laterally towards the center of the shoe from the position of pivot pad 28. Its distance of offset may be slightly greater than the distance of offset of pivot pad 30. The shoe embodiment shown by FIGS. 1–12 is intended to be a basketball shoe for players who shift their weight forwardly and rearwardly more than side to side. The shoe embodiment shown by FIGS. 13 and 14 is also intended to be a basketball shoe for players who tend to shift their weight more from side to side.

The regions of the shoe 10 outwardly of the pivot pads 20, 28, 20 are preferably formed to include a plurality of transverse slots, some of which are designated 40 and others are designated 42 (FIG. 2). The slots 40 are provided on the inside of the foot. They are parallel to each other and are spaced relatively close together (e.g. one-fourth inch center to center). The slots 42 on the outside of the foot are also parallel to each other. These slots are spaced apart a greater distance (e.g. about three quarters of an inch center to center). The slots 40, 42 decrease the thickness of the sole 12 where they are located to in this manner facilitate a bending or flexing of the sole 12 longitudinally of the shoe, or perpendicular to the slots 40. The portions of the sole 12 between adjacent slots 40 and between adjacent slots 42 function as 15 cleats for gripping the support surface 16.

The pivot pads 20, 28, 30 are positioned on the sole 12 such that there is essentially always a pivot pad below the region of the player's foot where the player's weight is being transmitted from the foot to the surface 16. This enables the player to easily pivot on his foot at essentially all times. The truncated nature of the secondary pivot pads do not inhibit their use. Pivoting is done at or near the pivot centers of these pads. The surface of the primary pivot pad 28 on the truncated side of each secondary pivot pad 20, 30 slopes upwardly toward the sole 12 and is not in a position to drag in a manner interfering with pivotal movement on a secondary pivot pad 20, 30.

What is claimed is:

1. A shoe, comprising:

a sole having a floor contacting bottom including:

a primary pivot pad that is substantially circular in plan form, located generally below the ball region of the user's foot, and presenting a downwardly directed convex pivot surface having a pivot center;

at least one secondary pivot pad adjacent said primary pivot pad;

said primary pivot pad extending laterally into and truncating said secondary pivot pad;

said secondary pivot pad having a concave side boundary adjacent the primary pivot pad and otherwise having a substantially circular plan form; and said secondary pivot pad presenting a downwardly directed convex pivot surface having a pivot center.

2. A shoe according to claim 1, wherein the secondary pivot pad is positioned forwardly on the sole from the primary pivot pad.

3. A shoe according to claim 2, further comprising a second secondary pivot pad positioned rearwardly of the primary pivot pad, said primary pivot pad extending laterally into and truncating said second secondary pivot pad, said secondary pivot pad having a concave side boundary adjacent the primary pivot pad and otherwise having a substantially circular plan form, and said second secondary pivot pad presenting a downwardly directed convex pivot surface having a pivot center.

4. A shoe according to claim 2, further comprising a second secondary pivot pad positioned generally laterally outwardly of the primary pivot pad, said primary pivot pad extending laterally into and truncating said second secondary pivot pad, said secondary pivot pad having a concave side boundary adjacent the primary pivot pad and otherwise having a substantially circular plan form, and said second secondary pivot pad presenting a downwardly directed convex pivot surface having a pivot center.

5. A shoe according to claim 1, wherein the secondary pivot pad is positioned rearwardly of the primary pivot pad.

6. A shoe according to claim 1, wherein the secondary pivot pad is positioned laterally outwardly from the primary pivot pad.

7. A shoe according to claim 1, wherein the secondary pivot pad is positioned rearwardly on the sole from the primary pivot pad, with the pivot center of the primary pivot pad being generally below the ball region of the user's foot and the pivot center of the secondary pivot pad being offset laterally from the pivot center of the primary pivot pad towards the center of the user's foot.

8. A shoe according to claim 7, wherein the sole includes a toe portion and a heel portion, and wherein said shoe sole has a static position on a support surface in which the heel portion makes support contact with the surface at the rear of the shoe and the secondary pivot pad makes support contact at a forward region on the shoe and said sole curves upwardly from the secondary pivot pad an amount sufficient to elevate the primary pivot pad and the toe portion of the shoe above the support surface.

9. A shoe according to claim 8, further comprising a second secondary pivot pad in the sole positioned in the toe portion of the shoe, forwardly of the primary pivot pad, said primary pivot pad extending into and truncating said second secondary pivot pad, said secondary pivot pad having a concave side boundary adjacent the primary pivot pad and otherwise having a substantially circular plan form, said second secondary pivot pad presenting a downwardly directed convex pivot surface having a pivot center which is offset laterally from the pivot center of the primary pivot pad towards the center of the user's foot.

10. A shoe according to claim 1, wherein the bottom of said sole includes a plurality of substantially parallel, transverse slots on each side of the primary pivot pad, for the purpose of rendering the bottom more flexible to facilitate bending of the sole in a direction perpendicular to the slots.

11. A shoe according to claim 9, wherein the secondary pivot pad is positioned rearwardly of the primary pivot pad and the said shoe includes a plurality of spaced apart, transverse slots in the bottom outwardly of the secondary pivot pad on both sides of the shoe, for the purpose of facilitating a bending of the bottom in a direction perpendicular to the slots.

12. A shoe according to claim 11, comprising a second secondary pivot pad positioned forwardly of the primary pivot pad, said primary pivot pad extending laterally into and truncating said secondary pivot pad, said secondary pivot pad having a concave side boundary adjacent the primary pivot pad and otherwise having a substantially circular plan form, and said second secondary pivot pad presenting a downwardly directing convex pivot surface having a pivot center, and said shoe having transverse slots in the sole bottom outwardly of the mid portion of the second secondary pivot pad, on both sides of the shoe, to facilitate bending of the shoe in a direction perpendicular to the slot.

* * * * *